United States Patent [19]

Voytko

[11] 4,249,689

[45] Feb. 10, 1981

[54] METHODS OF AND APPARATUS FOR ADVANCING ELONGATED MATERIAL

[75] Inventor: James E. Voytko, Doraville, Ga.

[73] Assignee: Western Electric Company, Inc., New York, N.Y.

[21] Appl. No.: 123,151

[22] Filed: Feb. 21, 1980

Related U.S. Application Data

[63] Continuation of Ser. No. 882,023, Feb. 28, 1978, abandoned.

[51] Int. Cl.[3] ..... B65H 17/34

[52] U.S. Cl. ..... 226/172; 198/620

[58] Field of Search ..... 226/170–172; 198/620–626, 627; 74/22; 28/729, 74; 64/30

[56] References Cited

U.S. PATENT DOCUMENTS

| | | | |
|---|---|---|---|
| 2,576,882 | 11/1951 | Koole et al. | 226/172 |
| 2,717,437 | 9/1955 | DeMestral | 28/72 |
| 2,897,425 | 7/1959 | Waring | 317/262 |
| 3,009,235 | 11/1961 | DeMestral | 28/78 |
| 3,015,427 | 1/1962 | Kessler | 226/172 |
| 3,143,895 | 8/1964 | Robie | 74/229 |
| 3,654,777 | 4/1972 | Grundman | 64/30 |
| 3,858,158 | 12/1974 | Henn et al. | 339/99 R |
| 3,880,274 | 4/1975 | Bechtloff et al. | 198/621 |
| 3,882,995 | 5/1975 | Uraya | 198/626 |

OTHER PUBLICATIONS

Advertisement Scotchmate Fasteners Design News Specifiers Annual, Aug. 1973.

Advertisement 3M Company, "Flexible Fasteners", Design News, Sep. 1973.

Western Electric Annual Report, 1977, pp. 8–11.

*Primary Examiner*—Leonard D. Christian

*Attorney, Agent, or Firm*—E. W. Somers

[57] ABSTRACT

A capstan having surfaces which are faced with elements that are capable of interlocking with each other is used to advance a strip of interconnected, miniature articles which have a configuration susceptible to deformation, or a strip having a surface finish which is easily narred. In one embodiment, the capstan includes a first belt having a plurality of flexible, resilient hooking elements attached to a surface thereof. A second belt has a plurality of looping elements made of flexible, resilient material attached to a surface thereof and which are capable of interlocking with the hooking elements of the first belt when the belts are pressed together and of becoming disengaged from the hooking elements when the belts are peeled apart. The belts are sufficiently flexible so that when they are pressed together they are capable of gripping an elongated material therebetween. The first and second belts are moved along paths with portions of the paths juxtaposed to cause successive portions of the belts to be moved into engagement to grip a strip of material therebetween, to be moved fastened together along the juxtaposed portions of the paths, and then to be peeled apart. The successive portions of the belts which are pressed together and then moved together before being pulled apart are sufficient to advance the strip in the direction of motion of the fastened portions of the belts.

8 Claims, 4 Drawing Figures

METHODS OF AND APPARATUS FOR ADVANCING ELONGATED MATERIAL

This is a continuation of application Ser. No. 882,023 filed Feb. 28, 1978 and now abandoned.

TECHNICAL FIELD

This invention relates to methods of and apparatus for advancing elongated material, and, more particularly, to a capstan which is particularly suited for advancing an elongated material such as a strip of interconnected, deformable articles or a strip of material having surfaces or surface finishes which are sensitive and easily marred.

BACKGROUND ART

In manufacturing operations, such as the plating and/or forming of a strip of material which is continuously or incrementally advanced, it is not uncommon for the material to be damaged by apparatus which is used to advance it. A conventional capstan which comprises two moving belts that cooperate by means of friction to engage and advance the strip may damage it because the configuration or the material of the strip is easily deformed or marred. Other capstans which positively engage the strip by means of pins or other devices that register with openings in the strip impart relatively high localized forces to the strip which tend to elongate it.

One example of the foregoing problem occurs as a strip of metal is advanced through a plurality of work stations and formed into miniature electrical contact elements such as those shown for example, in U.S. Pat. No. 3,815,830 issued Dec. 30, 1974 in the names of Henn et al. Because of the size of these elements, e.g. 19.05 mm overall length and thickness of only 0.508 mm, a capstan which is used to advance the strip must be such that it does not abuse the elements. This is especially true since the capstan typically is located adjacent a takeup where the formation of individual elements is almost or totally complete.

Another problem arises with respect to the advancement of strips of material having surfaces such as for example, plated surfaces, which may be easily marred. Conventional capstans which include cooperating belts or a reciprocally moveable pin to engage openings in the strip may mar the plating as well as abuse the individual elements. The problem of marring surface finishes is especially troublesome in those cases where the elongated material which is to be advanced comprises a solid strip with no openings therein to receive a pin of a reciprocally moveable capstan. Although they could be designed so as to overlap side longitudinal edges of the strip, belts would necessarily engage the flat surfaces of the strip and possibly cause damage thereto.

There are numerous products other than electrical connectors of the type described hereinbefore which are formed from an advancing strip and which because of their size or finish require special measures in order to be advanced without being damaged. The prior art does not appear to contain either the apparatus or the teaching to successfully advance elongated material which has sensitive surfaces or which comprises successively formed, deformable articles without causing damage thereto.

DISCLOSURE OF THE INVENTION

The foregoing problems of the prior art are solved by the apparatus of this invention which includes a capstan for advancing elongated material and which is particularly suited to advancing elongated material that is easily deformed or marred.

A capstan in accordance with this invention for advancing an elongated material includes a first endless surface having a plurality of elements made of flexible, resilient material attached thereto, and a second endless surface having a plurality of elements made of flexible, resilient material attached thereto and capable of interlocking with the elements of the first surface when said surfaces are pressed together and of becoming disengaged from the elements of the first surface when the surfaces are peeled apart. The first and second surfaces are sufficiently flexible that they conform to and grip an elongated material disposed therebetween when they are pressed together. Means are provided for moving the first and second surfaces along paths with at least portions of the paths juxtaposed to cause successive portions of the surfaces to be moved into pressed engagement with each other and with an elongated material disposed therebetween, to travel fastened together in the same direction along the juxtaposed portions of the paths, and then to be peeled apart at ends of the juxtaposed portions of the paths. The successive portions of the surfaces which are pressed together and then moved fastened together before being pulled apart are sufficient to cause an elongated material which is introduced and gripped between the successive pressed-together portions of the surfaces to be advanced in the direction of motion of the surfaces along the juxtaposed portions of their paths.

More particularly, a capstan in accordance with this invention includes a first belt having a plurality of looping elements made of flexible, resilient material attached to a surface thereof, and a second belt having a plurality of hooking elements made of flexible, resilient material attached to a surface thereof and capable of interlocking with the looping elements of the first belt when said surfaces of said belts are pressed together and of becoming disengaged from the looping elements when the surfaces are peeled apart. The belts are sufficiently flexible to conform to and grip a strip of material disposed therebetween when they are pressed together. Means support the first and second belts for movement along paths in opposite rotary directions with at least portions of their paths juxtaposed and adapted to have an elongated material disposed therebetween. When the surfaces are moved, successive portions of the belts are moved into pressed engagement with each other and into gripping engagement with the strip, are moved fastened together to advance the strip in the same direction along the juxtaposed portions of the paths, and are then peeled apart at ends of the juxtaposed portions of the paths. Sufficient areas of the surfaces are interlocked together along the juxtaposed portions of the paths to grip and advance the strip without the necessity of applying forces to the belts along the juxtaposed portions of the paths to compress the belts into frictional engagement with the strip.

This arrangement overcomes problems of prior art advancing apparatus by distributing the forces which are necessary for advancing the strip over a relatively large surface area to prevent relatively high localized forces from being imparted to the strip and by avoiding unduly high frictional forces in engagement with surfaces of the strip.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figures 1, 2, 3, 4:
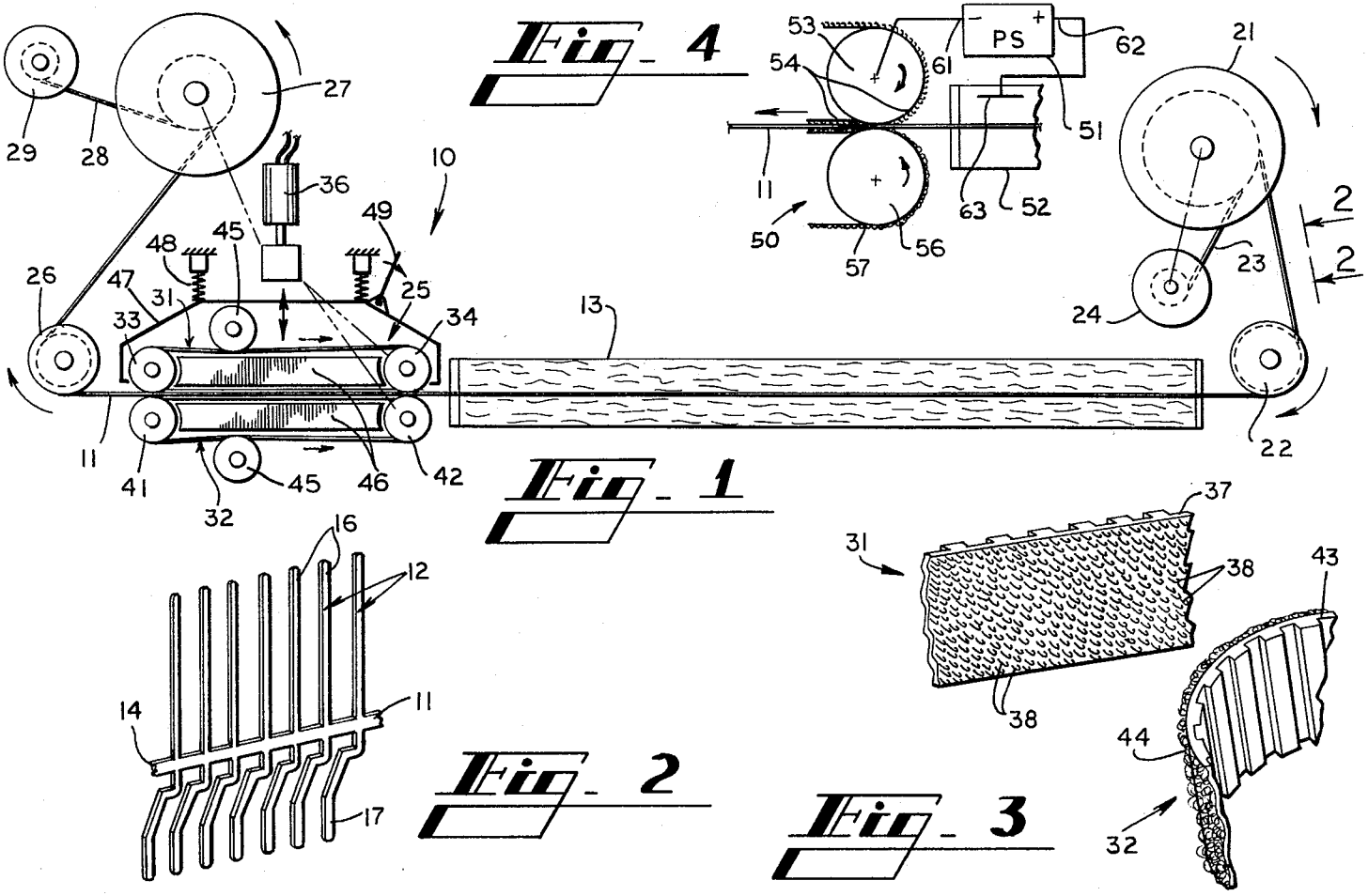
FIG. 1 is an overall view of a manufacturing line which includes a capstan constructed in accordance with this invention for advancing fragile or miniature articles interconnected in strip form.
FIG. 2 is an enlarged perspective view of a portion of a strip of connector elements which are advanced by a capstan of this invention without damage thereto.
FIG. 3 is an enlarged view of a portion of the capstan of FIG. 1 and showing one belt with a mass of looping elements upstanding therefrom for registration with the other belt which has a mass of hooking elements upstanding therefrom.
FIG. 4 is a side elevational view of an alternative embodiment of the invention and one in which this invention is used to cathodically charge the strip for an electroplating operation while simultaneously advancing the strip.

Referring now to FIG. 1 there is shown an apparatus, designated generally by the numeral 10, for continuously plating a strip 11 of connector elements in a plating bath 13. The connector elements 12—12 may be those shown, for example, in FIG. 2 and include a centrally extending bar 14 having a plurality of wire wrapping pins 16—16 extending laterally from one side thereof and having a plurality of offset wiping contact blades 17—17 extending from the bar in an opposite direction.

The apparatus 10 is used to plate the strip 11 of connector elements 12—12 with a metal, for example, such as gold or solder which is useful in the making of electrical connections. A roll 21 of the strip 11 of the connector elements 12—12 is mounted for rotation at one end of the plating bath 13. The strip 11 is advanced about a roller 22 and a strip 23 of paper which is interleaved with the strip of connector elements 12—12 for surface protection is taken up on a reel 24 as the elements are moved off the reel 21. Then the strip 11 is pulled into and through the plating bath 13 by a capstan, designated generally by the numeral 25, around a roller 26 and taken up on a reel 27. As the strip 11 of plated connector elements 12—12 is taken up on the reel 27, a strip 28 of paper which is payed off a reel 29 is inserted between successive convolutions of the strip 11 to protect the plated surfaces.

While the apparatus 10 is described with respect to the plating of the strip 11 of connector elements 12—12, it should be understood that the invention is applicable in general to the advancement of easily deformable, miniature articles which are interconnected in a strip from which they are formed in a continuous fashion. The capstan 25 provides the capability of advancing the strip 11 by engaging successive increments of its length with clamping forces which are sufficient to prevent slippage. At the same time, the localized forces are not so great as to mar the surface of the relatively thin strip nor to damage the individual connector elements 12—12.

Other kinds of connector elements 12—12 which may be advanced by the capstan of this invention includes those shown in U.S. Pat. No. 3,858,158 which was issued Dec. 31, 1974 in the names of Henn et al. Further, the plating bath 13 may simply include a trough such as is shown in FIG. 1 or it may include an apparatus for selectively plating areas of the strip such as disclosed in copending application Ser. No. 865,569 filed Dec. 29, 1977 in the names of M. J. Edwards and J. E. Voytko.

In order to advance the strip 11, the capstan 25 in a preferred embodiment comprises two belts, designated generally by the numerals 31 and 32, respectively, which cooperate to advance successive increments of length of the strip therebetween. The belt 31 forms a closed continuous path which is passed around two spaced rollers 33 and 34 of which the roller 34 is driven by a drive means 36 that drives synchronously the takeup reel 27. The belt 31 is provided with a fabric 37 that has a mass of hooking elements 38—38 upstanding therefrom (see FIG. 3).

The belt 32 also forms a closed continuous member which is advanced in a counter-clockwise direction as viewed in FIG. 1 around a roller 41 and a drive roller 42 that is driven by the drive 36. The belt 32 is provided with a layer of fabric 43 having a plurality of looping elements 44—44 (see FIG. 3) upstanding therefrom. Rollers 45—45 are arranged to provide adequate tension in the belts 31 and 32.

The material which is used to face the surfaces of the capstan 25 is described in U.S. Pat. No. 2,717,437, incorporated by reference hereinto, and includes a fabric having a foundation structure comprising woven threads that are cut a predetermined length to form a raised pile. The raised pile is made of a flexible, resilient material such as, for example, nylon or metal wire. Some of the threads in the pile are formed as looping elements while others are provided with material-engaging means adjacent their free ends by cutting the looping elements to produce hook-shaped ends. When two layers are pressed into face to face relation with one another, a substantial percentage of the hooking elements engage with other hooking elements and looping elements to fasten the two layers together until they are separated by peeling forces. An improved separable fastening device is shown in U.S. Pat. No. 3,009,235, and includes the use of one layer of fabric comprising hooking elements with a layer of fabric comprising the looping elements. Fastening systems such as those just described are available commercially from the Velcro Corp. of New York under the designation Velcro® brand hook and loop type fasteners and from the 3M Company under the designation Scotchmate® brand hook and loop fasteners.

It should also be understood that while the hooking and looping elements have been described as being woven, the invention also includes the use of belts 31 and 32 which are faced with material having molded hooking and looping elements. Also available from the 3M Company is a material known as a Hedlok®II brand fastener having fields of headed stems which interlock when pressed together.

The belts 31 and 32 are supported, so that portions of their paths are juxtaposed to cause successive opposed portions of their fabrics 37 and 43 to be pressed into engagement with each other at the confluence of the rollers 34 and 42, to be moved in the same direction along the juxtaposed portions of the paths and then to be peeled apart as the belts are moved in opposite rotary directions around the rollers 33 and 41. Advantageously, the belts 31 and 32 are sufficiently flexible so that as successive sections thereof are pressed into engagement with each other, they conform to the configuration of and grip the strip 11 which is disposed therebetween. The compliancy of the belts 31 and 32 with the strip 11 permits the interlocking of sufficient numbers of hooking and looping elements 38—38 and 44—44 through openings in the strip and along its longitudinal edges so that the fastened together, jutaposed portions between the rollers 33 and 41 and the rollers 34 and 42 are sufficient to overcome line friction and advance the strip.

However, it should be understood that the invention is not limited to the advancement of strips 11—11 having openings therein. For use with a solid strip 11, the belts 31 and 32 would be constructed to have a width which is greater than the width of the strip so that the hooking and looping elements of portions of the belts which overhang the strip are interlocked with each other and provide sufficient gripping engagement with the strip to advance it.

The unsupported length of the juxtaposed portions of the belts 31 and 32 between guides 46—46 is another feature of the invention. Since corresponding portions of the belts 31 and 32 are pressed into engagement at the confluence of the rollers 34 and 42, in compliant relation with the strip 11, the successive portions of the belts are held together until peeled apart. This permits the juxtaposed portions of the belts 31 and 32 between the two sets of rollers to be essentially unsupported without the use of back up pressure plates and hence avoids any undue frictional engagement on the deformable or surface-sensitive strip 11.

The width and the length of the belts 31 and 32 between the two sets of rollers 33, 41 and 34, 42 is determined empirically to provide sufficient area of interlock of the hooking and looping elements 38—38 and 44—44 to advance a particularly configured strip 11. The forces required must be sufficient to overcome line resistance such as that for example, which is offered by the plating bath 13.

While it is possible to support the belts 31 and 32 so that the strip 11 could be fed between their juxtaposed portions, a preferred embodiment of the invention includes provisions for initially stringing up the strip through the capstan 25. As can be seen in FIG. 1, the belt 31 and rollers 33 and 34 are disposed within a floating housing 47 that is normally biased into juxtaposition with the belt 32 by springs 48—48, but which is moveable reciprocally away from the belt 32 by a handle 49. In order to string up the capstan 25, an operator moves the handle 49 to overcome the springs 48—48 and move the belt 31 upwardly about 2 cm as viewed in FIG. 1. A leading portion of the strip 11 is pulled through the bath 13, through the capstan 25 and around the reel 27. Then the handle 49 is moved to permit the springs 48—48 to urge the belt 31 into juxtaposition with the belt 32.

The capstan arrangement is ideally suited for providing the forces which are required to separate the fabrics 37 and 43. Separation of the fabrics 37 and 43 requires a force of considerable magnitude if exerted in a direction substantially normal of the facing or directly parallel to the facing because of the need to release a large number of hooking and looping elements simultaneously. However, the fabrics 37 and 43 are separated by peeling the fabrics from each other. Again referring to FIG. 1 and in particular to FIG. 3, as the successive increments of the juxtaposed portions of the separable belts 31 and 32 are passed around the rollers 33 and 41 along divergent paths, peeling forces which are progressively applied to the belts are sufficient to disengage the hooking elements 38—38 from the looping elements 44—44 to separate the belts.

It should be understood that while in this description, the belt 31 having the hooking elements 38—38 and the belt 22 having the looping element 44 are both driven, it is possible that only one of the belts is driven in order to provide sufficient translatory forces for successive increments of length of the strip 11 which are introduced between the belts.

Also, while the capstan 10 is shown to include two belts 31 and 32 which are faced with hooking and looping elements 38—38 and 44—44, the invention is not so limited. What is important is that one surface is provided with a plurality of flexible elements and the other surface is provided with a plurality of flexible elements which are capable of interlocking with the elements of the one surface. The elements on the one surface, for example, may comprise hooking elements and the other surface may comprise looping elements or each surface may include both hooking and looping elements or the headed stem type elements mentioned hereinbefore.

In another embodiment of the invention, a capstan 50 (see FIG. 4) is used to provide electrical contact between a source of power 51 and the strip 11 in an electroplating cell 52 to cathodically charge the strip. The capstan 50 includes a first driven belt 53 having its surface faced with a plurality of flexible, resilient, looping elements 54—54. The capstan 50 also includes a second driven belt 56 having its surface faced with a plurality of flexible, resilient, hooking elements 57—57 that are capable of interlocking with the looping elements 54—54. By constructing the hooking elements 57—57 and the looping elements 54—54 from an electrically conductive flexible material such as brass and a plating which improves the conductivity, a connection may be made from a negative side 61 of the source of power 51 to the strip 11 to cathodically charge the strip. A positive side 62 of the power source 51 is connected to an electrode 63 in the plating cell 62. The area of the engaging portions of the paths of the two surfaces is determined to provide sufficient current to the strip 11 to electroplate portions of the strip.

EXAMPLE 1

In a capstan for advancing a strip 11 of connector elements such as those shown in FIG. 2 which have an overall width of about 27 mm, it was determined that a force of 356 Newtons was required to be exerted on the strip. The capstan was designed with Scotchmate® brand facing material 9 mm wide and having a shearing strength of 70 kilopascals (kPa). This required a facing material-to-strip contact of about 52.0 $cm^2$ which translated into a belt 31 and 32 of 9 mm in width and 58 cm in length being in contact with the strip 11. The belts 31 and 32 were advanced at a velocity of about 6.1 cm per second (cm/sec).

This example illustrates another advantage of the capstan 25 which is constructed in accordance with this invention. This width of the belts 31 and 32 in Example 1 was 9 cm for advancing articles three times that width. The belts 31 and 32 were designed to engage a portion of the length of the wire wrap tangs 16—16 of the connector elements. Since the wiping contacts 17—17 are out of plane with the remainder of the connector elements, the use of the capstan 25 to engage only a portion of the articles overcomes a problem inherent in advancing complex shapes.

EXAMPLE 2

Belts 31 and 32 were faced with Hi-Meg ®, a special electrically conductive material marketed by the Velcro Corp. of New York, N.Y., which includes a mass of hooking and looping elements made of a material such as brass wires which can be plated with a material such as, for example, cadmium, gold or silver. This material was found to have a current carrying capacity of 31 amps/decimeter$^2$. In order to electroplate a strip 11 of the connector elements 12—12 which is being advanced at a speed of 6.1 cm/sec and electroplated at a current of 10 amps, a surface contact area of 32 cm$^2$ is required. The belts 31 and 32 were designed so that a portion 2.5 cm wide and 12.7 cm in length of each belt was in engagement with the strip.

It is to be understood that the above-described arrangements are simply illustrative of the invention. Other arrangements may be devised by those skilled in the art which will embody the principles of the invention and fall within the spirit and scope thereof.

What is claimed is:

1. A capstan for advancing an elongated material, which includes:

a first endless surface having a plurality of elements made of flexible, resilient material attached thereto;

a second endless surface having a plurality of elements made of flexible, resilient material attached thereto and capable of interlocking with the elements of the first surface when said surfaces are pressed together and of becoming disengaged from the elements of the first surface when the surfaces are peeled apart, said first and second surfaces being sufficiently flexible to conform to and grip an elongated material disposed therebetween when they are pressed together, said elements of said first and second surfaces comprised of an electrically conductive material;

means for mounting the surfaces along paths with at least portions of the paths being juxtaposed to cause successive corresponding portions of the surfaces to be capable of being moved into pressed engagement with each other to grip an elongated material which is disposed therebetween, to be moved fastened together in the same direction along the juxtaposed portions of the paths, and then to be peeled apart, said successive portion sof the surfaces which are pressed together and then moved fastened together before being peeled apart being sufficient to advance the elongated material in the same direction as the surfaces along the juxtaposed portions of the paths, said means including means for supporting said surfaces along said juxtaposed portions of said paths without applying compressive forces to said surfaces along said juxtaposed protions;

means for moving said surfaces along said paths, the capstan further includes a source of power; and means for connecting said source of power to the elements to electrically charge the elongated material.

2. A capstan for advancing an indeterminate length of material which comprises a strip of interconnected articles, which includes:

a first belt having a plurality of looping elements made of flexible, resilient material attached to and extending substantially normal to a surface thereof;

a second belt having a plurality of hooking elements made of flexible, resilient material attached to and extending substantially normal to a surface thereof and capable of interlocking with the looping elements of the first belt when said surfaces of said belts are pressed together with an elongated strip of articles therebetween and of becoming disengaged from the looping elements when the surfaces are peeled apart, said belts being sufficiently flexible so that when pressed together they are capable of conforming to and gripping the elongated strip material disposed therebetween, said hooking and looping elements extending from said respective surfaces a distance which is sufficient to become interlocked with said strip therebetween;

a first pair of spaced rollers for supporting said first belt;

a second pair of spaced rollers for supporting said second belt;

means for supporting said first pair of rollers;

means for supporting said second pair of rollers so that the portion of the second belt between said second pair of rollers is capable of being juxtaposed with the portion of the first belt between the first pair of rollers;

means for normally urging said portions of the paths of the first and second belts into juxtaposition with each other;

means for mounting said supporting means for at least said first pair of spaced rollers to permit said supporting means for said first pair of rollers to be moved in a direction away from said second pair of spaced rollers to permit the strip to be positioned between said belts;

means for moving said means for mounting said supporting means for said first pair of spaced rollers in a direction away from said supporting means for said second belt to permit the strip to be positioned therebetween and subsequent to the positioning of the strip between said belts for moving said supporting means for said first belt toward said supporting means for said second belt; and means for moving the belts in opposite rotary directions along paths with a portion of the paths being along the juxtaposed portions of the belts to cause successive corresponding portions of the belts to be moved into pressed engagement with each other to grip a strip disposed therebetween with the hooking and looping elements extending through openings between the articles of the strip, to be moved fastened together in the same direction along the juxtaposed portions of the paths, and then to be peeled apart at ends of the juxtaposed portions of the paths, said successive portions of the belts which are pressed together and then moved fastened together before being peeled apart being sufficient to advance the strip in the same direction as the belts along the juxtaposed portions of the paths.

3. The capstan of claim 2 wherein the elongated material is a strip of material and the first and the second belts have a width which is greather than that of the strip so that the hooking elements interlock with the looping elements adjacent the longitudinal edges of the strip.

4. The capstan of claim 2, wherein the length and width of said juxtaposed portions of said surfaces are such that the juxtaposed, fastened together portions are sufficient to advance the elongated material in the same direction as the surfaces along the juxtaposed portions of the paths.

5. A method of advancing an elongated material, said method including:

moving a first endless surface having a plurality of elements made of flexible, resilient material attached thereto;

moving a second endless surface having a plurality of elements made of flexible, resilient material attached thereto and capable of interlocking with the elements of the first surface when the surfaces are pressed together and of becoming disengaged from the elements of the first surface when the surfaces are pulled apart, said first and second surfaces being sufficiently flexible to conform to and grip an elongated material disposed therebetween when they are pressed together; and causing the surfaces to be moved along paths with at least portions of the paths being juxtaposed to cause successive corresponding portions of the surfaces to be moved into pressed engagement with each other to grip an elongated material which is disposed therebetween, to be moved fastened together in the same direction along the juxtaposed portions of the paths, and then to be peeled apart, said successive portions of the surfaces which are pressed together and then moved fastened together before being pulled apart being sufficient to advance the elongated material in the same direction as the surfaces along the juxtaposed portions of the paths.

6. The method of claim 5, which also includes the step of supporting said surfaces along said juxtaposed portions without applying compressive forces to said surfaces therealong.

7. The method of claim 5, wherein said elements are made of a conductive material and said method also includes the step of connecting said elements to a source of power to electrically charge the elongated material.

8. The method of claim 5, wherein surface areas of said juxtaposed, fastened together portions are sufficient to overcome tension along a manufacturing line to advance said elongated material.

* * * * *